US006007361A

United States Patent [19]

Flachslaender

[11] Patent Number: 6,007,361

[45] **Date of Patent: *Dec. 28, 1999**

[54] ELECTRICAL SECURITY PLUG-TYPE CONNECTION FOR DIRECT AND CABLE-ATTACHED CONNECTING

[75] Inventor: Erwin Flachslaender, Calw, Germany

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/975,085

[22] Filed: Nov. 20, 1997

[30] Foreign Application Priority Data

Jul. 26, 1997 [DE] Germany ..... 297 13 333 U

[51] Int. Cl.[6] ..... H01R 13/627

[52] U.S. Cl. ..... 439/358

[58] Field of Search ..... 439/350, 353, 439/357, 677, 680, 358

[56] References Cited

U.S. PATENT DOCUMENTS 4,437,725 3/1984 Eaby et al. ..... 439/357

*Primary Examiner*—Gary F. Paumen

[57] ABSTRACT

An electrical plug-type connector is proposed with latching elements arranged on opposite sides of the connector for mechanical locking of the connector. The latching elements extend over not more than half the side of the connector and are arranged diagonally opposite one another such that when contact is made between complementary connectors, the respective latching elements along the sides of connectors are arranged adjacent to each other in a non-interfering manner.

5 Claims, 3 Drawing Sheets

ELECTRICAL SECURITY PLUG-TYPE CONNECTION FOR DIRECT AND CABLE-ATTACHED CONNECTING

FIELD OF THE INVENTION

The invention relates to electrical plug-type connectors with latching elements arranged on opposite sides of the connector for mechanical locking of the connector.

BACKGROUND OF THE INVENTION AND PRIOR ART

Electrical plug connections enjoy a wide variety of applications. It must initially be distinguished between A electrical plug connections for connecting individual devices via a direct connection or via a cable-attached connection. In the first case, direct connection, the devices to be brought into contact are done so directly via suitable plug connections; they are therefore in direct contact with one another and do not require a cable. Such direct connections find application for example in so-called docking stations, with which a portable computer can be integrated into a stationary computer system. In the second case, cable-attached, the devices to be in contact have suitable connectors such as plugs or sockets and are connected to each other via one or more cables.

Plug connections must be further classified as those with a security mechanism to protect against mechanical separation of the connection and those without such a mechanism. In the case of plug connections without a security mechanism, the mechanical grip of the connectors is effected primarily by friction between the connectors, but it is not protected from intentional or unintentional separation of the connection. In the case of connections with a mechanism safeguarding against mechanical separation of the connection, there is an intentional mechanical locking between the connecting elements themselves, in addition to a mechanical engagement of the connectors. This can be effected for example by threading, clamping, or latching.

Finally, in the case of plug connections with a mechanism to prevent mechanical slippage, distinction must be made between those with a fixed connection and those with a pull-apart separation function, for example when a tensile load exceeding a certain threshold is exerted. The former are effected primarily with screws, while the latter preferably have spring-loaded latching contacts that—with no tensile load—engage one another and, when a certain tensile load is applied, disengage and release the connection.

Electrical plug connections with a locking function are used almost exclusively for cable-attached connections and find only limited application in direct connections such as in a docking station. In particular, mechanical locking mechanisms with a pull-apart function under tensile load are not suited to use in direct connections, since it is usually undesirable to pull apart the devices connected by the plug connection in order to effect mechanical unlocking. Therefore, for a direct connection or cable-attached connection with integrated separation function under tensile load, different plug connections must be provided to prevent interference of the locking mechanisms.

FIG. 1 shows a prior art electrical plug connection. A plug 10 (male) is to be connected to a corresponding, complementarily shaped socket 20 (female). The plug 10 has contact elements 30 in a housing 40, a cable 50, and latching elements 60A and 60B. Socket 20, which for example can be built into a housing, has contact elements 70 complementary to the contact elements 30, a contact body 80, and latching elements 90A and 90B. When plug 10 and socket 20 are interconnected, latching elements 60B and 90B as well as 60A and 90A engage one another. This produces an integrated pull-apart function under tensile load exerted for example on cable 50, whereby the maximum tensile load, which leads to separation, depends on the geometric design of the latching elements 60A, 60B, and 90A, 90B, and in particular on the shape of any undercut 95A, 95B, as well as on the material used in this case.

When using socket 20 for a direct connection, the latching elements 90A and 90B are typically omitted.

SUMMARY OF THE INVENTION

It is an object of the present invention to provide an electrical plug connection that permits both direct and cable-attached connecting, whereby at least the cable-attached connection supports a pull-apart separation function under tensile load.

The object is satisfied by the characteristics of the independent claims.

In accordance with the invention, an electrical plug-type connector has latching elements arranged on opposite sides of the connector for mechanical locking of the connector, whereby the latching elements are designed such that they extend over a portion of the respective side of the connector and are arranged along the side of the connector such that when contact is made between complementary connectors the respective latching elements along the sides of the connectors are arranged adjacent to one another in a non-interfering manner.

The latching elements are preferably arranged diagonally opposite each other and/or extend over no more that half the side of the connector.

The latching element arrangement of the invention, in which the extension is over only part of a side, such that on contact the latching elements of complementary connectors either engage or not, permits connecting either with or without mechanical locking via the latching elements, as desired. Thus, when equipping devices with complementary sockets in accordance with the invention, for example, these devices can be brought into electrical contact via these sockets without making use of engagement via the latching elements when the contact is made. However, when connecting these devices to the sockets in accordance with the invention using a conventional cable with corresponding plugs, which are complementary to the respective sockets, mechanical locking occurs via the mutual engagement of the latching elements.

BRIEF DESCRIPTION OF THE DRAWINGS

The invention will be explained in more detail with reference to the drawings, in which.

DETAILED DESCRIPTION OF THE DRAWINGS

Figure 1:
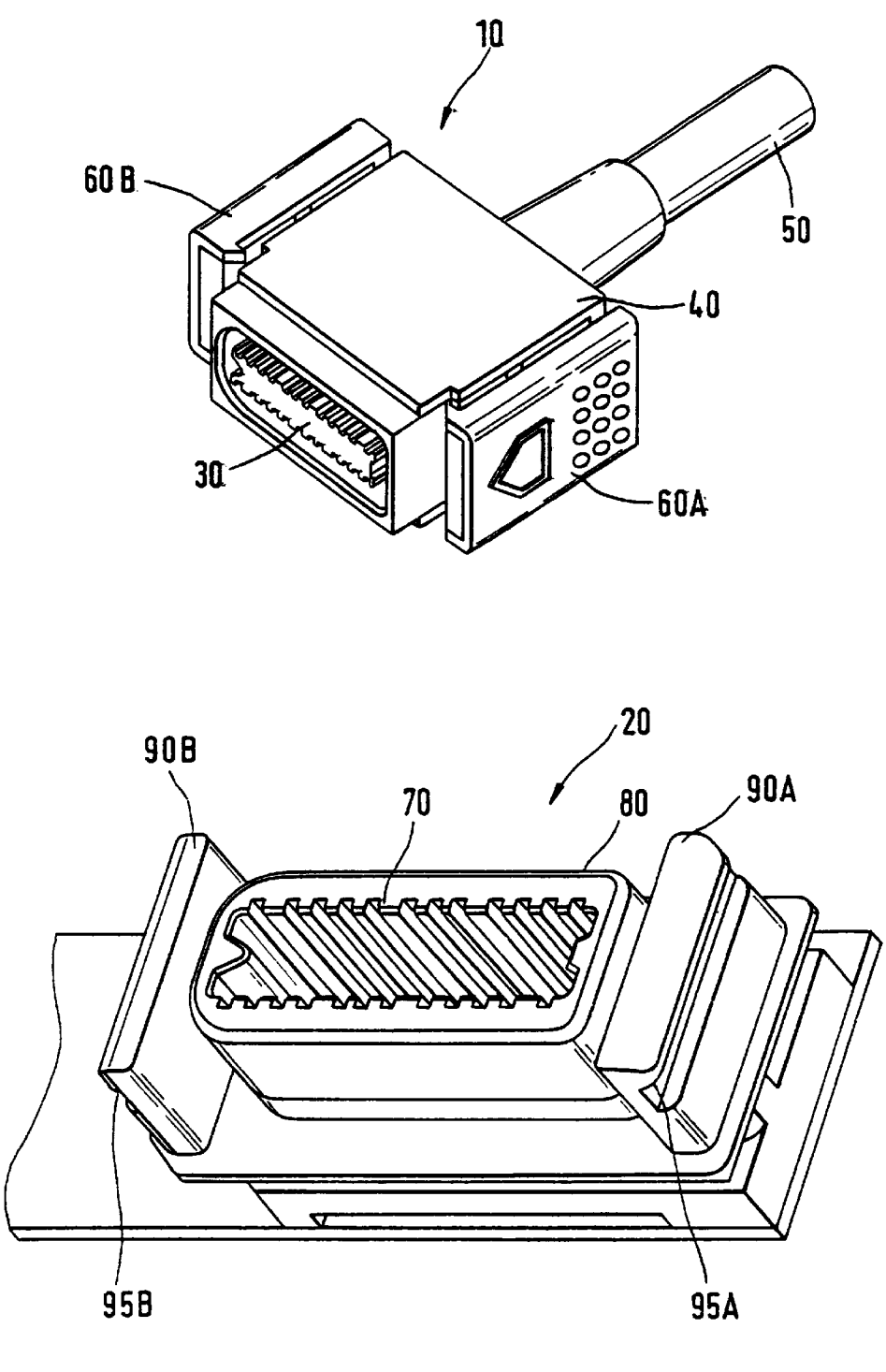
Fig.1 (PRIOR ART)
FIG. 1 is a prior art electrical plug connection.
Figure 2:
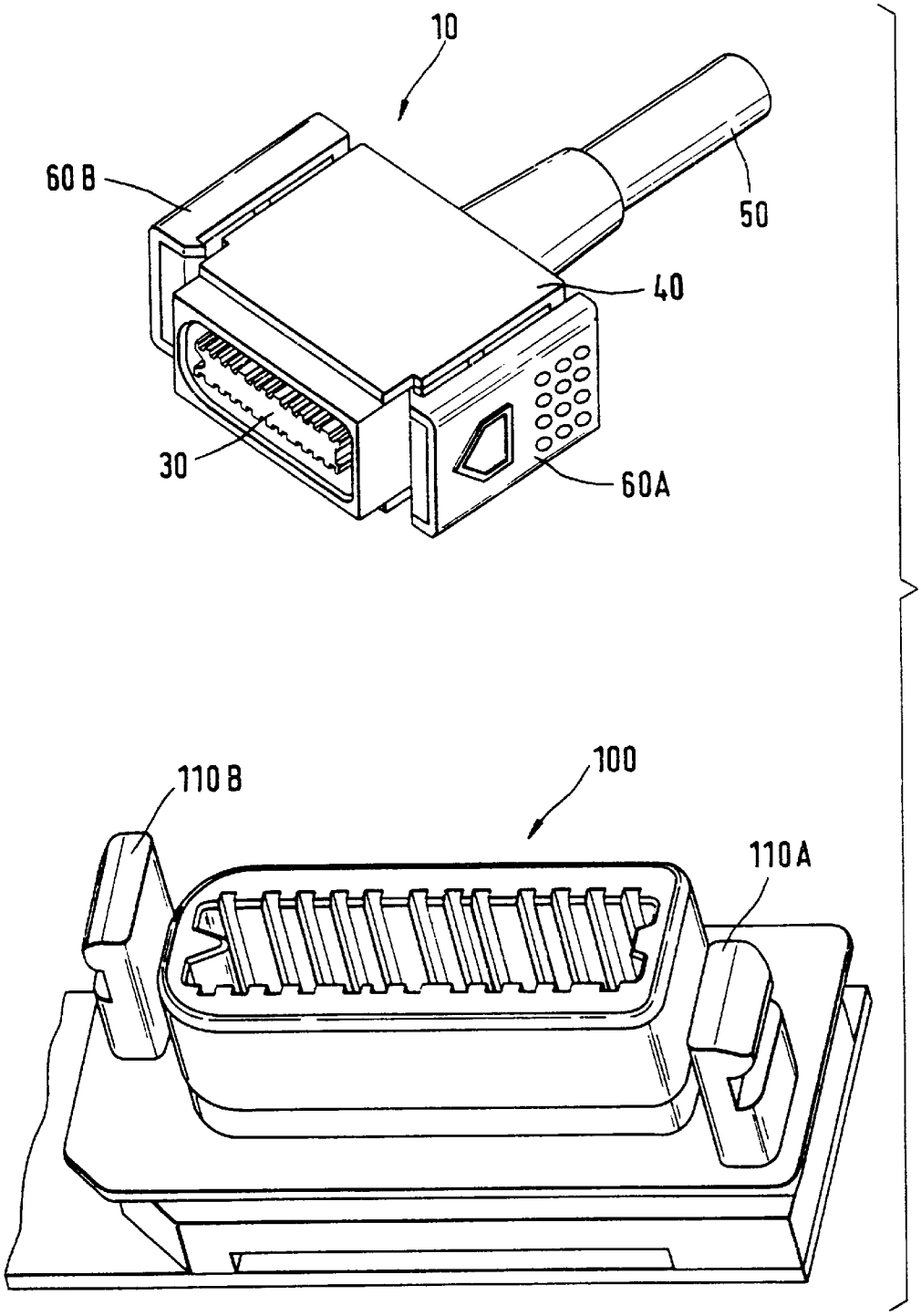
FIG. 2 is a plug connection of the invention.

FIG. 2 shows a plug connection according to the invention. The plug 10 can remain unchanged from the embodiment of FIG. 1. A socket 100 of the invention has latching elements 110A and 110B that, in contrast to socket 20, do not extend over the full width of socket 100 but rather preferably not more than half the width of socket 100. Furthermore, the latching elements 110A and 110B are arranged preferably diagonally opposite one another, as is shown in FIG. 2. The shape of latching elements 110A and 110B can—except for the extension along the side—correspond essentially to that of the latching elements 60A and 60B, or 90A and 90B, and in particular have suitable undercuts 95A, 95B.

Figure 3:
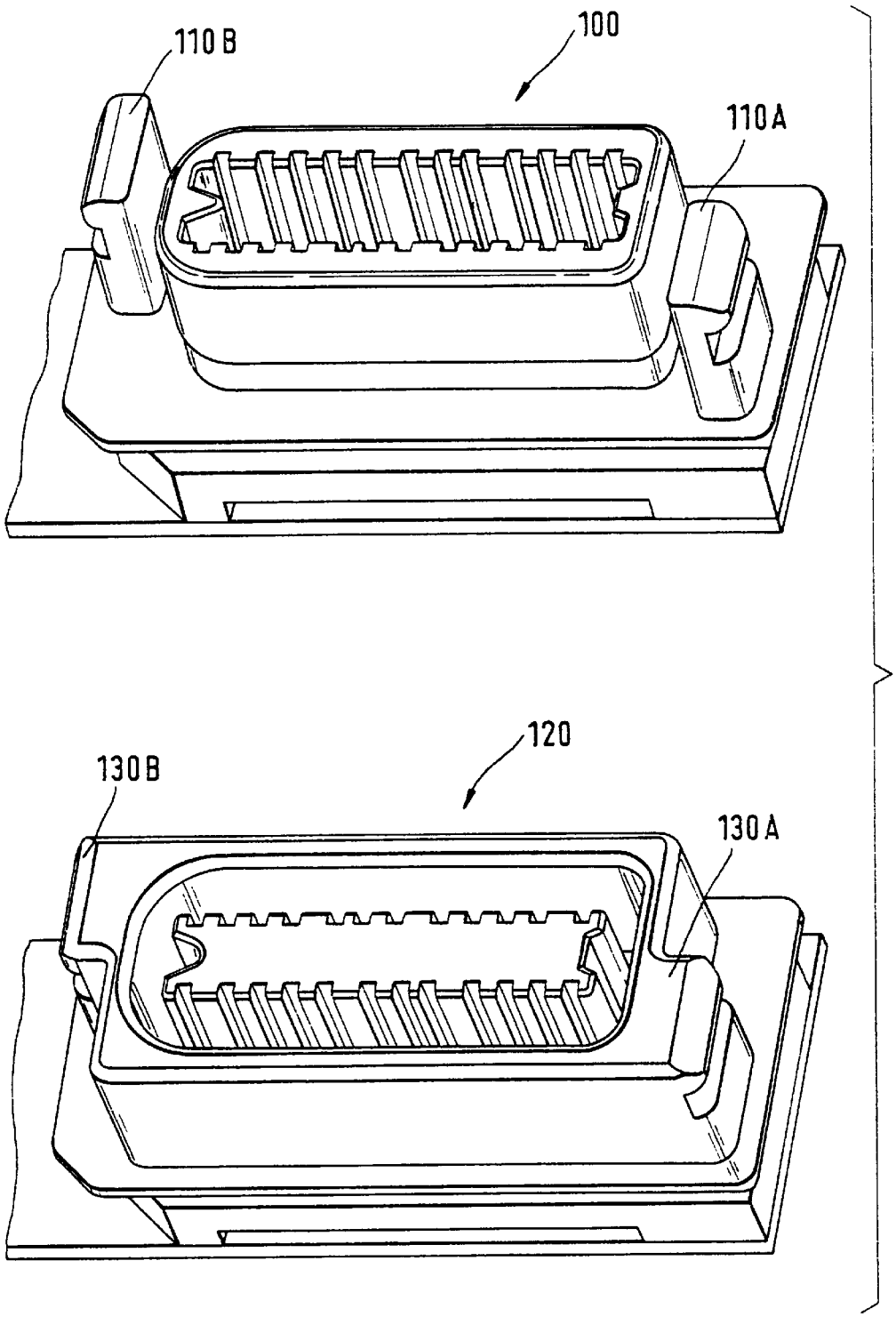
FIG. 3 shows the female socket 100 from FIG. 2 and a male socket 120 suited to connecting to socket 100.

FIG. 3 shows socket 100 (female) of FIG. 2 and a socket 120 (male) complementary thereto, which is suited to making contact with socket 100. Socket 120 also has latching elements 130A and 130B that, in correspondence to latching elements 110A and 110B of socket 100, occupy not more than half the side of the socket and are arranged diagonally opposite each other.

Sockets 100 and 120 now can, on the one hand, be brought into contact with a plug 10 attached in accordance with FIG. 1 or 2 via cable, or directly with each other, whereby in the latter case the latching elements 110B and 130B and 10A and 130A are arranged adjacent to one another along the sides. In other words, when sockets 100 and 120 are in contact, the latching elements on the same side in each case, 110B and 130B and 110A and 130A, are adjacent to one another, without interfering by latching with or blocking one another. In the case of direct connection, such as with a docking station, no use is made of the functionality of the respective latching elements 110 and 130, namely that of mechanical fixation.

It should be noted that while sockets 100 and 120, which are complementary, preferably find application in a device, they are not limited thereto and can also be used for cable connections; in this case no use is made of the security locking when using complementary plugs and sockets 100 and 120 as in FIG. 3.

On the other hand, when sockets 100 or 120 are connected—either directly or via cable—to a corresponding plug 10 in accordance with FIG. 2, mechanical locking is effected via the latching elements 60 and 110 or 130. The positioning of the latching elements 110A and 110B, or 130A and 130B, in diagonally opposite arrangement ensures sufficient mechanical fixation effected by the area described by latching elements 90A and 90B for latching of the socket and plug.

It should be noted that the complementary latching elements 110A and 110B, or 130A and 130B, which are adjacent along one side of socket 100 or 120 when contact is made, need not be arranged symmetrically, as shown in FIG. 3, but rather can have different lengths along the side of the connector. In addition, latching elements 110A and 110B, or 130A and 130B, can be of almost any length, as long as this does not lead to overlap with the complementary latching elements. For example, the latching element 110A of socket 100 can extend over ⅔ of the connector width, while latching element 110B extends over only ⅓ of the connector width. Correspondingly, latching element 130A of socket 120 can then extend over not more than ⅓ of the connector width, while latching element 130B can extend over not more than ⅔ of the connector width.

It should also be noted that the latching elements 110A and 110B, or 130A and 130B, need not be arranged diagonally opposite one another, but rather can lie along one side along the connector axis (length). In this case, the latching elements of the plug and those of the socket must, when contact is made, lie on opposite sides along the width. However, reduced locking action must be expected in this case due to the smaller area described by the latching elements.

The latching element arrangement of the invention over only part of the side, such that when contact is made the latching elements of complementary connectors are either engaged or not, permits the option of connecting either with or without mechanical locking via the latching elements. In this way, for example, if devices are equipped with complementary sockets 100 or 120 in accordance with FIG. 3, these devices can be brought into electrical contact via these sockets 100 and 120 without making use of the engagement via latching elements 110 or 130 in this contact arrangement. If these devices are connected to the sockets 100 or 120 via a cable 50 with corresponding plugs 10, which are respectively complementary to sockets 100 or 120, however, mechanical locking is effected by the mutual engagement of the latching elements 60 and 110 or 130.

It should be noted that the terms used herein such as socket or plug are not limited functionally to use in a device or on a cable but are rather exchangeable and merely reflect the function of complementary engagement. Accordingly, the elements designated as sockets 100 or 120 in FIG. 3 can just as well functionally represent plugs, and the element designated as plug 10 can also functionally be a socket.

I claim:

1. A connector arrangement comprising:

a first connector body including first opposed latching elements arranged on opposite sides of the first connector body, said first opposed latching elements extending only over a portion of respective sides of the first connector body, said first connector body configured to mate with both a second connector body and a third connector body, said third connector body having opposed latching elements that interact with said first opposed latching elements in a mechanical latching manner; and the second connector body with second, opposed latching elements, said second opposed latching elements respectively positioned in complementary positions to said first opposed latching elements on said second connector body, so that when said first connector body and second connector body are mated, said first opposed latching elements and second opposed latching elements are arranged adjacent to each other in a non-interfering manner.

2. A connector in accordance with claim 1, wherein the latching elements on said first connector body are arranged diagonally opposite one another.

3. A connector in accordance with claim 1, wherein the latching elements on said first connector body extend over not more than half the side of the body.

4. An electrical connector assembly comprising:

a male connector body including first latching elements arranged on opposite sides of the male connector body for mechanical locking of the connector body, said first latching elements extending only over a portion of the respective sides of the male connector body for interacting with a female connector body with opposed type latching elements; and a female connector body for mating with said male connector body in a non-latching manner and including second latching elements arranged on opposite sides of the female connector body and extending over only a portion of the respective sides of the female connector body, for interfacing with a male connector body with opposed type latching elements, said first latching elements and second latching elements respectively positioned in a complementary positions so that when said male connector body and female connector body are mated, said first latching elements and second latching elements are arranged adjacent to each other in a non-interfering manner.

5. A connector assembly comprising:

a first connector body including first latching means for mechanically latching with second latching means of a corresponding second latching type connector, said first latching means extending only over a portion of the first connector body; and a third connector body including third latching means, said first latching means on said first connector body positioned in a complementary fashion to said third latching means on said third connector body, so that, when said first connector body and third connector body are mated, said first latching means and said third latching means are arranged adjacent to each other in a non-interfering manner.

* * * * *